US005450660A

United States Patent [19]

Frano

[11] Patent Number: 5,450,660

[45] Date of Patent: Sep. 19, 1995

[54] ADJUSTABLE FASTENER

[75] Inventor: Francis G. Frano, Hoffman Estates, Ill.

[73] Assignee: Illinois Tool Works Inc., Glenview, Ill.

[21] Appl. No.: 206,844

[22] Filed: Mar. 7, 1994

[51] Int. Cl.[6] ..... A44B 11/26

[52] U.S. Cl. ..... 24/585; 24/685 K

[58] Field of Search ..... 24/68 R, 580, 584, 585, 24/573.1, 16 PB, 665, 685 K

[56] References Cited

U.S. PATENT DOCUMENTS

| | | | |
|---|---|---|---|
| 1,278,783 | 9/1918 | Stoner | 24/585 |
| 1,908,232 | 5/1933 | Freysinger | 24/585 |
| 1,910,891 | 5/1933 | Freysinger . | |
| 2,328,995 | 9/1943 | Olds | 24/585 B |
| 2,461,309 | 2/1949 | Cedar . | |
| 3,267,545 | 8/1966 | Eckart . | |
| 4,559,679 | 12/1985 | Downey . | |
| 4,831,694 | 5/1989 | Kong . | |
| 5,184,352 | 2/1993 | Maufette . | |

FOREIGN PATENT DOCUMENTS

| | | | |
|---|---|---|---|
| 678600 | 9/1952 | United Kingdom | 24/585 |

*Primary Examiner*—James R. Brittain
*Attorney, Agent, or Firm*—Schwartz & Weinrieb

[57] ABSTRACT

A fastener including an engagement member having a predetermined length and a receiving member for connection substantially anywhere along the length of the engagement member and being readily movable in at least a first direction along the length of the engagement member.

20 Claims, 2 Drawing Sheets

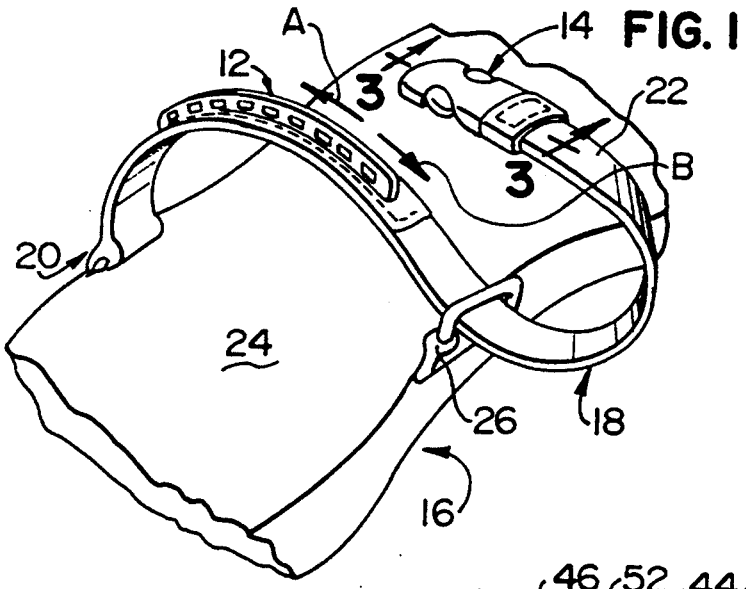
FIG. 1
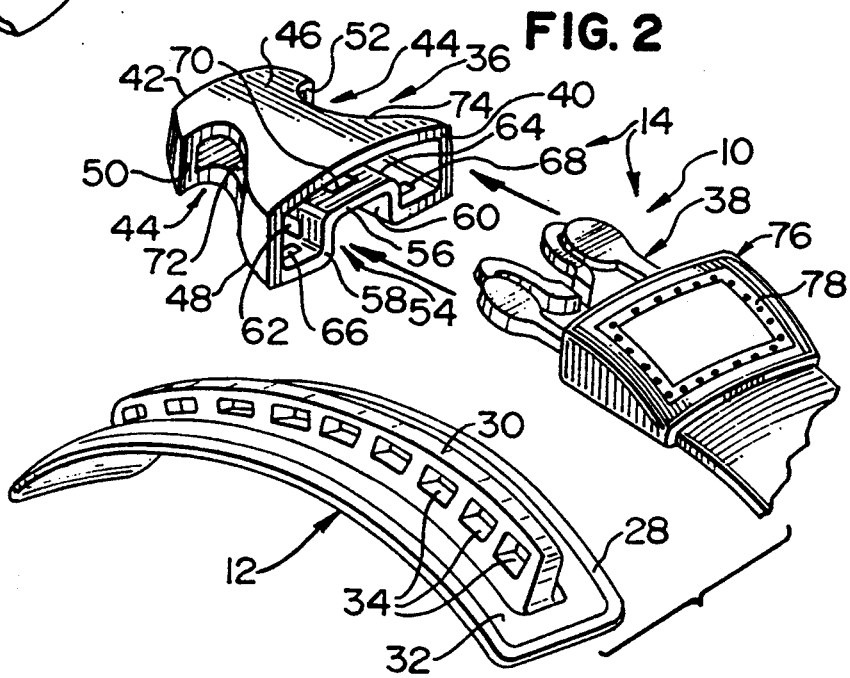
FIG. 2
FIG. 3
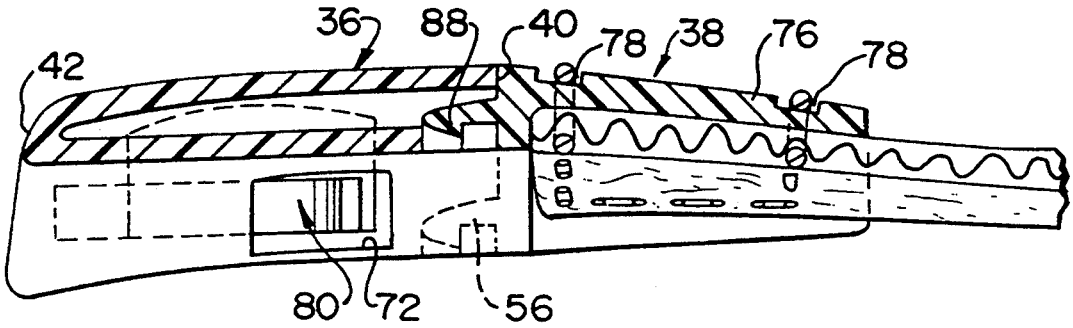

ADJUSTABLE FASTENER

TECHNICAL FIELD

The present invention relates generally to fasteners, and more particularly, to an adjustable fastener including an elongate engagement member or track and a corresponding receiving member or housing where the housing can be readily connected substantially anywhere along the length of the track in a direction substantially perpendicular to the length of the track, adjusted in at least a first direction along the length of the track and manipulated by a user to provide movement or adjustment in a second direction opposite the first direction.

BACKGROUND OF THE INVENTION

Fasteners for connecting two articles include some type of track member secured to one article and some type of receiving member secured to another article for engagement with the track member. Such fasteners, however, typically require that the receiving member be threaded onto a free end of the track member which can be difficult or impossible in some applications.

In order to prevent having to thread the receiving member onto a free end of the track, fasteners have been developed which utilize synthetic materials which adhere when pressed together, such as VELCRO. This type of fastener typically includes two mating strips of desired lengths and enables connection of one strip anywhere along the length of the remaining strip.

In some applications, however, VELCRO type fasteners do not perform very well. This is particularly true when such fasteners are applied to garments, shoes or similar items which are exposed to dirt or sand. The dirt or sand clogs the fibers of a VELCRO type fastener thereby reducing its effectiveness and possibly causing failure during use.

It therefore would be desirable to provide a fastener including an engagement member having a predetermined length and a receiving member for connection anywhere along the length of the engagement member without having to thread the receiving member onto a free end of the engagement member, that enables ready adjustment in at least a first direction, and can be manipulated by a user to provide adjustment in a second opposite direction.

SUMMARY OF THE INVENTION

The invention provides a fastener including an engagement member having a predetermined length and a receiving member for connection to the engagement member. The receiving member is capable of engaging the engagement member substantially anywhere along the length of the engagement member and is capable of moving in at least a first direction along the length of the engagement member.

The receiving member is preferably connected to the engagement member in a direction substantially perpendicular to the length of the engagement member. Additionally, the receiving member can include a release mechanism for activation by a user to enable movement of the receiving member in a second direction opposite the first direction along the length of the engagement member.

BRIEF DESCRIPTION OF THE DRAWINGS

Various other objects, features, and attendant advantages of the present invention will be more fully appreciated from the following detailed description, when considered in connection with the accompanying drawings, in which like reference characters designate like or corresponding parts throughout the several views, and wherein:

FIG. 1 is a perspective view of the fastener of the invention illustrated for use with a strap of a sandal;

FIG. 2 is an exploded perspective view of the fastener of the invention;

FIG. 3 is a partial cross-sectional view of the fastener of the invention taken along line 3—3 of FIG. 1 in the direction indicated by the arrows;

DESCRIPTION OF THE PREFERRED EMBODIMENTS

Figure 4:
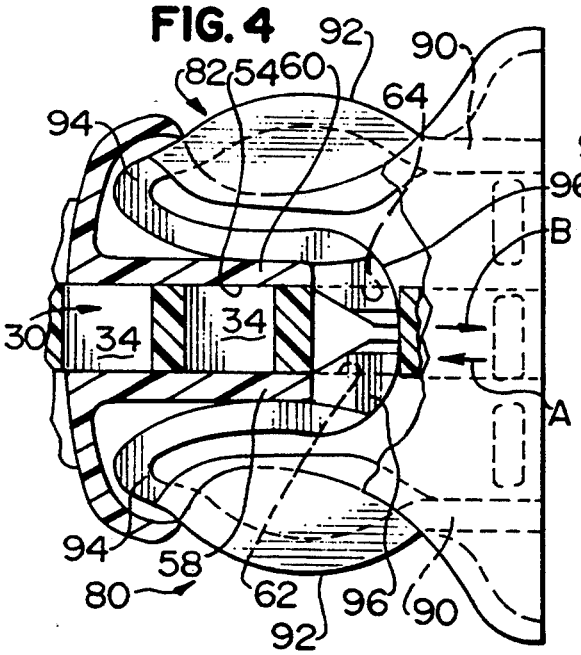
FIG. 4 is a top plan view, in partial section, of the fastener of FIG. 3 illustrating the engagement of the receiving member with the elongate track.

Referring to FIG. 2, the fastener of the invention is designated generally by the reference numeral 10. The fastener 10 substantially includes an engagement member 12 and a receiving member 14 for connection anywhere along the length of the engagement member 12.

The fastener 10 is preferably formed from plastic and is utilized to releasably and adjustably connect two articles together or to connect two portions of the same article. In FIG. 1, for example, the fastener 10 is illustrated for use with a sandal 16 having a strap 18.

The strap 18 includes first and second opposite ends 20 and 22 where the first end 20 is connected to one side of a sole 24 of the sandal 16. The second end 22 is threaded through a buckle 26, which is connected to the opposite side of the sole 24, and is connected to the receiving member 14 as described below.

Briefly, in operation, a user inserts a foot (not illustrated) beneath the strap 18 between the first connected end 20 and the buckle 26 on the sole 24. The strap 18 is pulled snug against the top of the foot and the second end 22 with the receiving member 14 is folded back over the strap 18. The receiving member 14 is then inserted downward with respect to FIG. 1 onto the engagement member 12 anywhere along its length.

Upon proper seating of the receiving member 14 with the engagement member 12, the receiving member 14 maintains its position thereon. To tighten the strap 18, the receiving member 14 is merely moved in the direction of arrow "A", which is to the left with respect to FIG. 1, where it engages another portion of the engagement member 12 and remains secured in that position.

To loosen the strap 18, the receiving member 14 is manipulated by a user to move in the direction of arrow "B", which is to the right with respect to FIG. 1 Alternatively, the receiving member 14 can be manipulated by a user to disengage a latch member from the receiving member 14, the latch member being connected to the second end 22 of the strap 18. Structural details of the fastener 10 will now be provided.

As FIG. 2 illustrates, the engagement member 12 is preferably slightly arcuate in shape to conform to a user's foot, has a predetermined length, is substantially flexible and includes a base or flange 28 and an upstanding track 30. The flange 28 preferably has a reduced thickness along a line 32 which extends about the perimeter of the flange 28 and enables the flange 28 to be sewn to the strap 18 along the line 32.

The track 30 extends upwardly away from the flange 28 a predetermined distance and includes a plurality of lateral apertures 34 extending therethrough. The apertures are preferably rectangular in shape for engagement with the receiving member 14 as described below. It is to be understood that the number and shape of the apertures 34 can vary so long as they function as described herein.

The receiving member 14 includes a female receptacle member 36 and a male latch member 38 for insertion therein. The female receptacle member 36 is substantially formed with an hour-glass configuration having a first open end 40, a second opposite closed end 42, a reduced intermediate portion 44, top and bottom surfaces 46 and 48 and opposite sides 50 and 52.

To accept the track 30 of the engagement member 12, the bottom surface 48 of the female receptacle member 36 includes an open longitudinal channel 54 formed along its length defined by a top surface 56 and opposite side surfaces 58 and 60. To enable portions of the male latch member 38 to engage the track 30, the side surfaces 58 and 60 include slots 62 and 64, respectively, extending therethrough.

To connect the male latch member 38 to the female receptacle member 36, the bottom surface 48 of the female receptacle member 36 includes two apertures 66 and 68 positioned proximate the sides 58 and 60 of the channel 54 and the top 56 of the channel 54 includes a similar aperture 70. These apertures 66, 68 and 70 accept engagement legs of the latch member 38 as described below.

In order to enable a user to access the male latch member 38 to provide movement of the receiving member 14 on the engagement member 12 in the direction of arrow "B" the sides 50 and 52 of the female receptacle member 36 include slots 72 and 74 along the intermediate portion 44.

Figure 6:
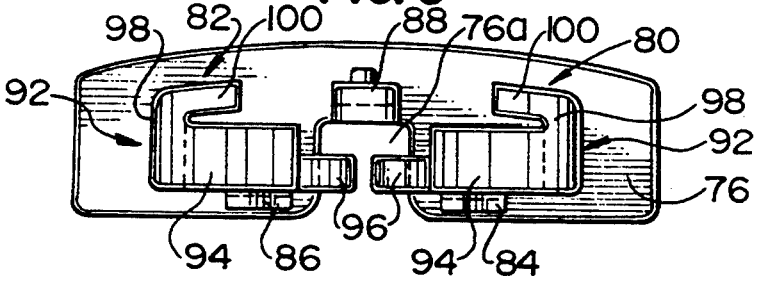
FIG. 6 is a front elevational view of a male latch member of the fastener of the invention.
Figure 7:
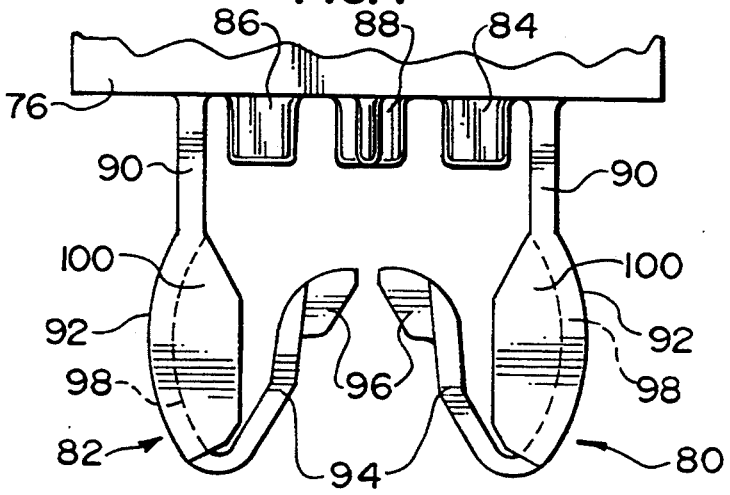
FIG. 7 is a top plan view of the male latch member illustrated in FIG. 6.

As FIGS. 2, 6 and 7 illustrate, the male latch member 38 includes a base member 76 having a substantially rectangular shape and a channel 76*a* therethrough for feeding of the track 30. To connect the base member 76 to the second end 22 of the strap 18, the base member 76 includes a rectangular shaped channel 78 formed on a top surface thereof with a reduced thickness. The channel 78 enables the base member 76 to be sewn to the strap 18.

As FIGS. 6 and 7 illustrate, in order to connect the male latch member 38 to the female receptacle member 36 and to engage the track 30 of the engagement member 12 within the channel 54, the base member 76 includes two leg members 80 and 82 extending therefrom. To assist in maintaining the male latch member 38 within the female receptacle member 36, the base member 76 also includes three engagement latches 84, 86 and 88 for seating within the apertures 66, 68 and 70 in the female receptacle member 36.

The leg members 80 and 82 each include a stem portion 90, a body portion 92, a neck portion 94, a head portion 96 and are substantially mirror images of each other. The body portions 92 of the legs 80 and 82 extend through the slots 72 and 74, respectively, of the female receptacle member 36 and can be accessed by a user to move the receiving member 14 on the engagement member 12 as described below.

The body portions 92 are hollow and include an exterior wall 98 and a top cover portion 100. Additionally, the neck 94 and head 96 of each leg 80 and 82 are positioned below the top cover 100 so that they can flex inward beneath the top cover 100 for release of the fastener 10.

Figure 5:
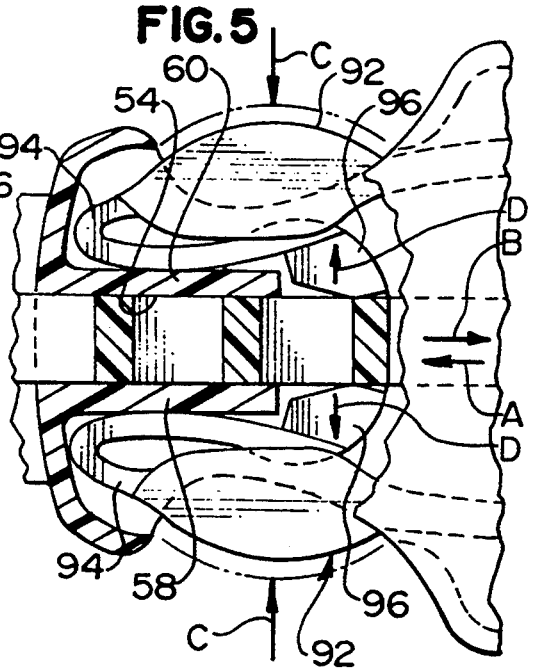
FIG. 5 is a top plan view, in partial section, similar to FIG. 4, illustrating release of the receiving member to enable movement of the receiving member in either direction along the elongate track.

As FIGS. 4 and 5 illustrate, the heads 96 of the legs 80 and 82 extend through the slots 62 and 64 in the sides 58 and 60 of the channel 54 to engage the apertures 34 of the track 30. Once positioned within the slots 62 and 64, the flexible legs 80 and 82 enable the receiving member 14 to move in a ratcheting manner along the track 30 of the engagement member 12 in the direction of arrow "A", which is to the left with respect to FIG. 4. The legs 82 and 80, however, prevent movement of the receiving member 14 in the direction of arrow "B", which is to the right As FIG. 5 illustrates, to move the receiving member 14 in the direction of arrow "B", the body portions 92 of each leg 80 and 82 are pressed inward in the direction of arrows "C". Due to the shape of the neck portions 94, however, the neck portions 94 engage the sides 58 and 60 of the channel 54 and force the head portions 96 of the legs 80 and 82 to move in an opposite direction indicated by arrows "D".

The legs 80 and 82 thereby disengage from the aperture 34 to enable movement of the receiving member 14 along the track 30 to the right in the direction of arrow "B". Upon release of the body portions 92, the legs 80 and 82 snap back to engage a different aperture 34.

To initially engage the receiving member 14 with the track 30 of the engagement member 12, the receiving member 14 is positioned over any portion of the track 30. Upon downward movement of the receiving member 14 onto the track 30 substantially perpendicular to the length of the track 30, the head portions 96 of the heads 90 of the legs 80 and 82 engage the track 30, flex away from the channel 54 and then snap inward to be seated within an aperture 34.

In operation, a user slips a foot under the strap 18 and onto the sole 24 of the sandal 16. The receiving member 14 with the second end 22 of the strap 18 connected thereto is then pulled in the direction of arrow "A" above the engagement member 12 until the desired tightness in the strap 18 is achieved.

The receiving member 14 is then moved downward substantially perpendicularly onto the engagement member 12 for connection at that point as described above. If the strap 18 requires further tightening, the user merely slides the receiving member 14 along the engagement member 12 in the direction of arrow "A" until satisfied with the fit. The receiving member 14 ratchets along the engagement member 12 and maintains this adjusted position provided by the user.

To loosen the strap 18 for comfort or to remove the sandal 16, a user depresses the body portions 92 of the receiving member 14 as described above which permits the receiving member 14 to slide in the direction of arrow "B" or to be removed from the engagement member 12. The sandal 16 can then be removed from a user's foot.

Modifications and variations of the present invention are possible in light of the above teachings. It is to be understood that within the scope of the claims the invention may be practiced other than specifically described.

I claim:

1. A fastener, comprising:

a track member having a predetermined length and a plurality of apertures defined therethrough along said predetermined length;

a housing member having a channel portion open along one side thereof for receiving said track member therein; and ratchet-type detent latch means disposed within said housing member for selected engagement within said through-apertures of said track member so as to permit said housing member to be moved along said track member in a first direction and prevent said housing member from being moved along said track member in a second opposite direction.

2. The fastener as defined in claim 1 wherein said housing member connects along the length of said track member in a direction substantially perpendicular to the length of said track member.

3. The fastener as defined in claim 1 wherein said housing member includes a release mechanism for activation by a user to move said housing member in said second direction along the length of said track member substantially opposite said first direction.

4. A fastener as set forth in claim 3, wherein:

said housing member comprises a pair of slots defined within opposite side walls thereof; and said release mechanism comprises a pair of legs operatively connected to said latch means and projecting outwardly through said slots defined within said side walls of said housing member so as to be accessible to said user for activating said latch means to a release position at which said latch means are removed from said through-apertures of said track member whereby said housing member is permitted to be moved in said second direction along said track member.

5. A fastener as set forth in claim 1, wherein:

said latch means comprises a pair of oppositely disposed laterally spaced latching members for receiving said track member therebetween and for engaging opposite sides of said through-apertures defined within said track member.

6. A fastener as set forth in claim 1, wherein:

said track member comprises a base portion extending along said length thereof; and an upstanding ridge portion disposed upon one side of said base portion;

said plurality of apertures being defined within said upstanding ridge portion of said track member.

7. A fastener, comprising:

a track member having a predetermined length and a plurality of apertures defined therethrough along said predetermined length;

a housing member having a channel portion open along one side thereof for receiving said track member therein; and ratchet-type detent latch means disposed within said housing member for selected engagement within said through-apertures of said track member so as to permit said housing member to be connected to said track member at substantially any position along the length of said track member, to permit said housing member to be moved along said track member in a first direction, and to prevent said housing member from being moved along said track member in a second opposite direction.

8. The fastener as defined in claim 7 wherein said latch means connects said housing member to said track member in a direction substantially perpendicular to the length of said track member.

9. The fastener as defined in claim 7 wherein said latch means can be manipulated by a user to permit movement of said housing in said second direction along the length of said track member substantially opposite said first direction.

10. The fastener as defined in claim 7 wherein both said track member and said latch means can be connected to a respective article for adjustable connection between said articles.

11. The fastener as defined in claim 7 wherein both said track member and said latch means can be connected to respective portions of the same article for adjustable connection between said respective portions.

12. The fastener as defined in claim 7 wherein said track member includes a base portion along its length and an upstanding ridge along one side of said base portion, said ridge including said plurality of apertures therethrough for engagement by said latch means.

13. The fastener as defined in claim 12 wherein said latch means includes at least one flexible leg member for releasable engagement with said apertures of said ridge of said track member.

14. A fastener as set forth in claim 13, wherein:

said latch means comprises a pair of laterally spaced, flexible leg members for releasable engagement within said apertures of said ridge of said track member.

15. The fastener as defined in claim 12 wherein said base portion of said track member includes a portion having a reduced thickness for enabling said base member to be sewn to another article through said portion of reduced thickness.

16. In combination, a fastener system for adjusting a strap member, comprising:

a strap member;

a track member, secured to a first portion of said strap member, having a predetermined length and a plurality of apertures defined therethrough along said predetermined length;

a housing member connected to a second portion of said strap member and having a channel portion open along one side there-of for receiving said track member therein; and ratchet-type detent latch means disposed within said housing member for selected engagement within said through-apertures of said track member so as to permit said housing member to be moved along said track member in a first direction and to prevent said housing member from being moved along said track member in a second direction whereby said second portion of said strap member can be adjustably positioned with respect to said first portion of said strap member.

17. The fastener system as set forth in claim 16 further comprising:

release means operatively connected to said latch means for releasably activating said latch means so as to operatively remove said latch means from said through-apertures of said track member and thereby permit said housing member to be moved along said track member in said second direction.

18. The fastener system as set forth in claim 17 wherein:

said housing member comprises a pair of slots defined within opposite side walls thereof;

said latch means comprises a pair of laterally spaced, detents for engaging opposite sides of said through-apertures defined within said track member; and said release means comprises a pair of legs operatively connected to said pair of detents and projecting outwardly through said slots defined within said side walls of said housing member so as to be accessible to a user for activating said detents to a release position at which said detents are removed from said through apertures of said track member whereby said housing member is permitted to be moved in said second direction along said track member.

19. The fastener system as set forth in claim 16, wherein:

said track member comprises a base portion extending along said length thereof and secured to said first portion of said strap member;

an upstanding ridge portion is disposed upon one side of said base portion; and said plurality of apertures are defined within said upstanding ridge portion of said track member.

20. The fastener system as set forth in claim 16, wherein:

said strap member comprises a footwear strap operatively secured to opposite sides of an article of footwear so as to adjustably secure said article of footwear to a foot of a user.

* * * * *